US008285180B2

(12) United States Patent
Sawano et al.

(10) Patent No.: US 8,285,180 B2
(45) Date of Patent: Oct. 9, 2012

(54) IMAGE FORMING APPARATUS

(75) Inventors: Ichiro Sawano, Izumisano (JP); Shigeo Uetake, Takatsuki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 207 days.

(21) Appl. No.: 12/886,869

(22) Filed: Sep. 21, 2010

(65) Prior Publication Data

US 2011/0091248 A1 Apr. 21, 2011

(30) Foreign Application Priority Data

Oct. 17, 2009 (JP) ..... 2009-239920

(51) Int. Cl.
*G03G 15/09* (2006.01)

(52) U.S. Cl. ..... 399/269

(58) Field of Classification Search ..... 399/26, 399/269

See application file for complete search history.

(56) References Cited

U.S. PATENT DOCUMENTS 6,735,410 B2 * 5/2004 Sekiguchi ..... 399/269
7,941,079 B2 * 5/2011 Hatano ..... 399/269

FOREIGN PATENT DOCUMENTS

JP 05-150636 6/1993
JP 2005-037523 2/2005

* cited by examiner

*Primary Examiner* — Hoang Ngo
(74) *Attorney, Agent, or Firm* — Brinks Hofer Gilson & Lione

(57) ABSTRACT

An image forming apparatus provided with a hybrid development apparatus having a plurality of toner carriers, the image forming apparatus having the following constitution: a magnet roller incorporated in a developer carrier is rotated and adjusted and fixed at an appropriate magnetic pole position with respect to one toner carrier; the other toner carrier is moved around the magnet roller shaft having a certain gap therebetween and adjusted and fixed at an appropriate magnetic pole position; and gap members are provided on each toner carrier, and the gap members are brought into contact with an image carrier by a guide member and an bias member provided on the image forming apparatus, thereby maintaining a specific development gap.

6 Claims, 7 Drawing Sheets

IMAGE FORMING APPARATUS

This application is based on Japanese Patent Application No. 2009-239920 filed on Oct. 17, 2009, in Japanese Patent Office, the entire content of which is hereby incorporated by reference.

TECHNICAL FIELD

The present invention relates to an image forming apparatus including a development apparatus having: a plurality of toner carriers for supporting and conveying on a surface thereof toner to develop an electrostatic latent image formed on an image carrier; and a developer carrier for supporting and conveying on a surface thereof developer to supply toner in the developer to the plurality of toner carriers.

The present invention relates to an image forming apparatus, using an electrophotographic method, such as a copying machine or a printer, and relates to a development apparatus used to develop an electrostatic latent image formed on an image carrier. In particular, the present invention relates to a hybrid development apparatus in which toner is supplied to a plurality of toner carriers from a developer carrier supporting and conveying thereon a developer containing carrier and toner, and then an electrostatic latent image on an image carrier is developed by a plurality of the toner carriers each having a toner layer formed thereon; and an image forming apparatus using the same.

BACKGROUND

Conventionally, a single-component development method only using toner as developer and a two-component development method using toner and carrier are known as development methods for developing an electrostatic latent image formed on an image carrier in image forming apparatuses using electrophotographic methods.

In such a single-component development method, toner is commonly passed through a regulation section formed by a toner carrier and a regulation plate pressed against the toner carrier, thereby the toner is charged and a desired toner thin layer can be obtained, resulting in advantages in simplification, miniaturization, and cost reduction of an apparatus.

However, toner deterioration can be easily accelerated due to strong stress caused by such a regulation section, and the charge acceptance of toner can be easily decreased. Further, a regulation member as a charge providing member for toner and the surface of a toner carrier are contaminated with toner or external additives, whereby charge providing properties for the toner is decreased, whereby the charge amount on the toner is further decreased and problems such as fogging are caused. As a result, the service life of a development apparatus is usually shortened.

In contrast, in a two-component development method, toner is triboelectrically charged by being mixed with carrier, whereby causing small stress, and the carrier has a strong resistance to the contamination with toner or external additives, since the area of carrier surface is large.

However, in such a two-component development method, when an electrostatic latent image on an image carrier is developed, the image carrier surface is brushed with a magnetic brush formed of developer, resulting in such a problem that magnetic brush traces are generated in a developed image. Further, a carrier is easily allowed to adhere to the image carrier, resulting in the problem of image defects.

A so-called hybrid development method as a development method is proposed (refer to, for example, Unexamined Japanese Patent Application Publication No. H05-150636) to solve such an image defect problem and to realize high image quality comparable to that of a single-component development method while the service life is as long as a two-component development method using a two-component developer, in which hybrid development method a two-component developer is supported on a developer carrier and only toner is supplied from the two-component developer to a toner carrier for development.

However, in the hybrid development method of Unexamined Japanese Patent Application Publication No. H05-150636, there were problems such as decrease in density at a high development speed and development hysteresis (ghost)

The decrease in density at a high development speed is a problem where the flying of toner is not enough for a development nip time at a high speed image forming, thereby resulting in decrease in density.

The above problem is in common with noncontact single-component development. It has not been taken as a serious problem, since it has been used only in a slow speed region to avoid a problem of heat generation at a regulation section or a problem of toner fusion. In the hybrid development, these problems do not exist, whereby image formation can be carried out at a substantially high speed. However, for example, in an apparatus having a system speed of more than 500 mm/s, there is a possibility that the above problems are caused.

The problem of development hysteresis (ghost) is a commonly included in the hybrid development methods, and is a phenomenon where a post-development residual toner on a toner carrier which has not been used for development appears on a image as a development hysteresis (ghost) at the next development step.

In a facing portion (supply region) between the toner carrier and the developer carrier for supplying the toner carrier with toner, the toner is supplied, but the recovery of the post-development residual toner is conducted in the same facing portion. In the facing portion, a bias is applied in a such a direction that the toner is supplied in order to supply toner. This bias hinders the recovery of toner and the capability of recovering toner is not enough, whereby the difference in amount of residual toner between portions will appear as a contrast in density in the next development step.

As a countermeasure against the density decrease at high speed development, a method is proposed, in which a plurality of toner carriers are provided to lengthen the development time for toner flying to ensure toner density (for example, refer to Unexamined Japanese Patent Application Publication No. 2005-37523).

In the configuration of Unexamined Japanese Patent Application Publication No. 2005-37523, even when a photoreceptor is rotated at a high speed, owing to the plurality of toner carriers, toner can be flown more than once, whereby a toner image is surly formed on the photoreceptor, thereby reducing the density decrease of the toner image due to a higher speed. It is also disclosed that this configuration reduces the occurrence of ghost because a smaller amount of toner per a toner carrier is used for development in this case than in the case of only one toner carrier used for development, whereby the difference in density between the portions where the toner is used for development and the portions where the toner is not used for development is kept small.

However, in the hybrid development method, image forming highly depends on the distance between the image carrier and the toner carrier. Therefore, in order to obtain an appropriate image density of a formed image, needed is a configuration where the distance between the image carrier and each of the toner carriers is stably secured to be uniform in each axis direction.

In order to form an appropriate amount of toner thin layer on each of the toner carriers, magnetic poles must be provided in the developer carrier each to be face each of the toner carrier at an appropriate position With the plurality of toner carrier provided, there is a high possibility of the errors to be high: the error of the position of the magnetic pole in the facing portion between each of the toner carriers and the developer carrier; and the error of the distance between each of the toner carriers and the developer carrier.

With the plurality of toner carrier provided, there may be a possibility of interference where the adjustment of position and distance for one of the magnetic poles causes error for other magnetic poles. The adjustment was difficult.

SUMMARY

In view of forgoing, one embodiment according to one aspect of the present invention is an image forming apparatus, comprising:

an image carrier;

a development apparatus configured to develop with toner an electrostatic latent image formed on the image carrier, the development apparatus including:

a first toner carrier and a second toner carrier which are provided to face the image carrier, and each of which is configured to support the toner on a surface thereof and to convey the toner to develop the electrostatic latent image formed on the image carrier;

a developer carrier, the developer carrier having:

a magnet roller having a rotary shaft and a plurality of magnetic poles around the rotary shaft, the magnetic roller being capable of rotation about the rotary shaft to adjust positions of the magnetic poles; and a sleeve roller which is provided to face the first toner carrier and the second toner carrier and is configured to contain therein the magnet roller and to be rotatable, independently of the magnet roller, about the rotary shaft, and configured to support thereon developer containing toner and carrier and to convey the developer to supply the toner in the developer to the first toner carrier and the second toner carrier;

a first adjustment member which is mounted on the rotary shaft so as to rotate the magnet roller and is configured to adjust and then to fix the magnet roller so that a facing portion between the developer carrier and the first toner carrier is located at a predetermined position with respect to the magnetic poles;

a holding member which is provided to be connected with the rotary shaft of the magnet roller and to be rotatable about the rotary shaft, and configured to rotatably hold the second toner carrier at a position thereof which is a predetermined distance away from a position at which the holding member is connected with the rotary shaft;

a second adjustment member which is provided in contact with the holding member and is configured to rotate the holding member about the rotary shaft of the magnet roller and then to fix the holding member such that a facing portion between the image carrier and the second toner carrier is located at a predetermined position with respect to the magnet poles;

a pair of first gap members each of which is provided, on each of both end portions of the first toner carrier, coaxially with the first toner carrier, and has an outer diameter larger than a diameter of the first toner carrier;

a pair of second gap members each of which is provided, on each of both end portions of the second toner carrier, coaxially with the second toner carrier, and has an outer diameter larger than a diameter of the second toner carrier;

a guide member configured to guide the development apparatus in such a direction that all of the first gap members and the second gap members approach the image carrier; and a bias member configured to bias the development apparatus in such a direction that all of the first gap members and the second gap members are in contact with the image carrier.

DETAILED DESCRIPTION OF THE PREFERRED EMBODIMENT

One embodiment of the present invention will now be described with reference to drawings.

(Constitution and Operation of an Image Forming Apparatus)

Figure 1:
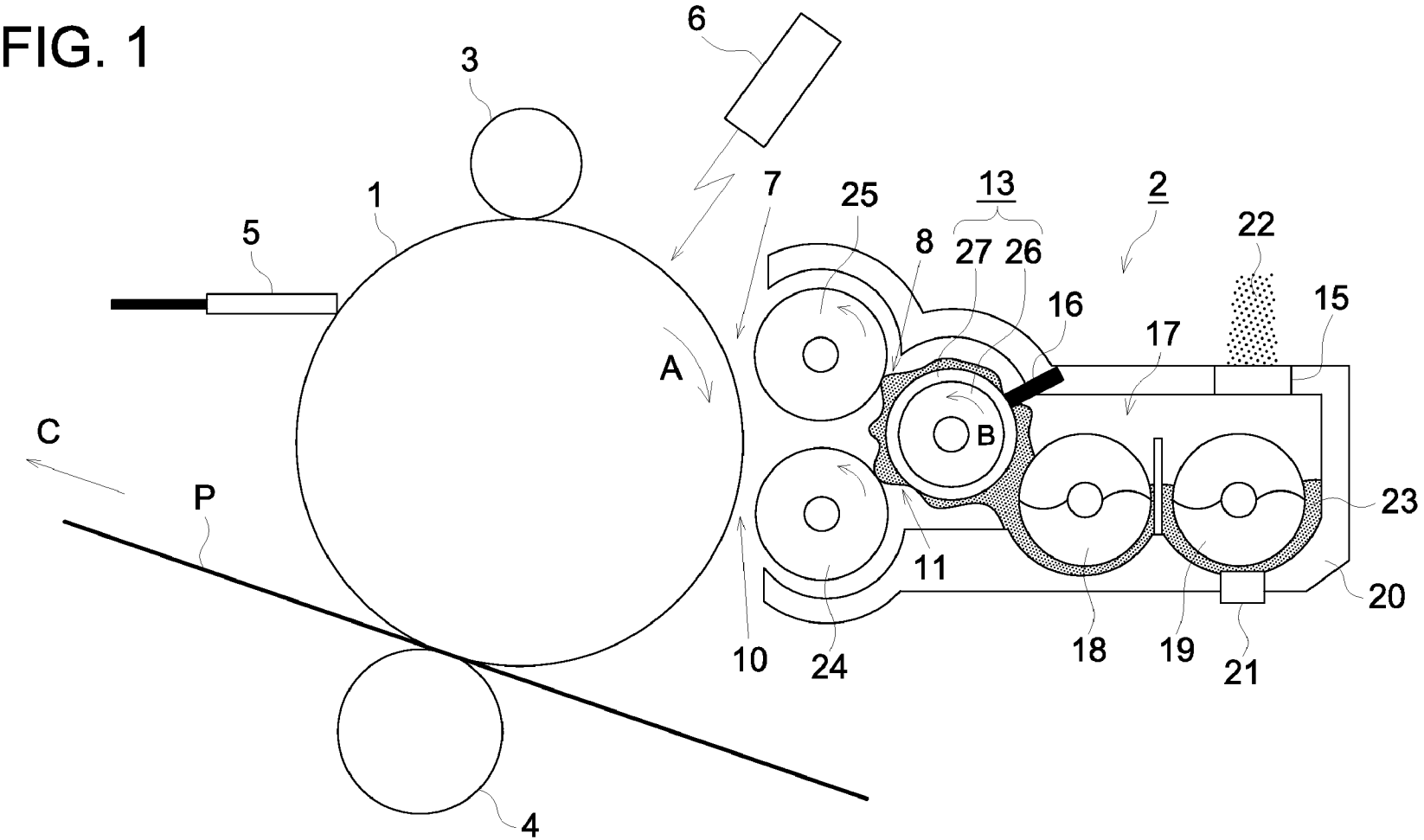
FIG. 1 is a configuration diagram showing a schematic configuration of an image forming apparatus according to the present invention.

FIG. 1 shows a constitution example of a main section of an image forming apparatus according to an embodiment of the present invention. With reference to FIG. 1, a schematic constitution and operation of an image forming apparatus according to the present embodiment will be described.

This image forming apparatus is a printer carrying out image formation by transferring a toner image formed on image carrier (photoreceptor) 1 by an electrophotographic system onto transfer medium P such as paper.

The image forming apparatus has image carrier 1 to support an image thereon. In the periphery of image carrier 1, there are arranged, in a sequential order along rotating direction A of image carrier 1, charging member 3 as a charging member to charge image carrier 1; development apparatus 2 to develop an electrostatic latent image on image carrier 1; transfer roller 4 to transfer a developed toner image on image carrier 1 on to transfer medium P conveyed by a conveyance device (not shown); and cleaning blade 5 to remove the residual toner on image carrier 1 after transfer. Image carrier 1 may has a belt shape instead of the drum shape shown in the figure.

Image carrier 1 is charged by charging member 3 and exposed by exposure apparatus 6 provided with a laser emitting device to form an electrostatic latent image on the surface thereof. Development apparatus 2 develops this electrostatic latent image to form a toner image. Transfer roller 4 transfers the toner image on image carrier 1 onto transfer medium P, and then discharges transfer medium P in the direction of arrow C of the drawing.

On the discharged transfer medium P, the toner image is fixed by a fixing apparatus to be a n output image.

Cleaning blade 5 removes the post-development residual toner on image carrier 1 by a mechanical force.

As image carrier 1, charging member 3, exposure apparatus 6, transfer roller 4, and cleaning blade 5 used in such an image forming apparatus, any well-known technologies of the electrophotographic method can be appropriately employed. For example, a charging roller is illustrated as a charging member in the drawing, but other charging apparatus can be used not in contact with image carrier 1. Regarding exposure apparatus 6, a laser ddvice may be replaced by an exposure apparatus having LEDs arranged in a row, for example. Further, for example, cleaning blade may not be included.

Next, the constitution of a fundamental section of development apparatus 2 using the hybrid development method according to the present embodiment will be described.

Development apparatus 2 has the following constitutional elements: developer tank 17 accommodating developer 23 containing carrier and toner; developer carrier 13 conveying thereon developer 23 supplied from developer tank 17; and first toner carrier 24 and second toner carrier 25 both for developing an electric latent image formed on the image carrier 1, to which toner carriers only toner is supplied from the developer carrier 13.

The detailed constitution and operation of development apparatus 2 will be described later.

(Composition of Developer)

The present embodiment employs the hybrid development method. For this reason, an appropriate two component developer is used as developer. In particular, the developer used in the present embodiment contains toner and carrier to charge the toner.

<Toner>

The toner is not specifically limited, and any well-known and commonly used toner can be employed. Usable are binders that contain colorant, and if desired, charge control agent or releasing agent, and are treated with external additive. Toner particle diameter is preferably about 3-15 μm in general without being limited thereto.

To produce such toner, production can be carried out by any well-known method being commonly used. The production can be performed, for example, using a pulverization method, an emulsion polymerization method, or a suspension polymerization method.

As binder resin, colorant, charge control agent, releasing agent uses for the toner, well-known ones can be used.

As the additive agent, well-known and generally used one can be used. As the additive agent, opposite polarity particles having the chargeability of opposite polarity to the toner can be used.

<Carrier>

The carrier is not specifically limited. Any well-known carrier and commonly used carrier can be employed. Binder-type carrier and coat-type carrier can be used. Carrier particle diameter is preferably 15-100 μm in general without being limited thereto.

The binder-type carrier is a carrier in which magnetic fine particles are dispersed in binder resin. Chargeable fine particles of positive or negative chargeability can be fixed on the carrier surface, or a surface coating layer can also be provided.

As the binder resin and the magnetic fine particles used for the binder-type carrier, well-known and generally used ones can be used.

On the other hand, the coat-type carrier is a carrier in which carrier core particles incorporating a magnetic material are resin-coated. Also in the coat-type carrier, similarly to the binder-type carrier, chargeable fine particles of positive or negative chargeability can be fixed onto the carrier surface.

The mixing ratio of toner and carrier only has to be adjusted to obtain a desired toner charge amount. The toner mixing ratio is typically 3-50% by mass, preferably 6-30% by mass, with respect to the total amount of the toner and the carrier.

(Constitution and Operation of Development Apparatus 2)

Figure 2:
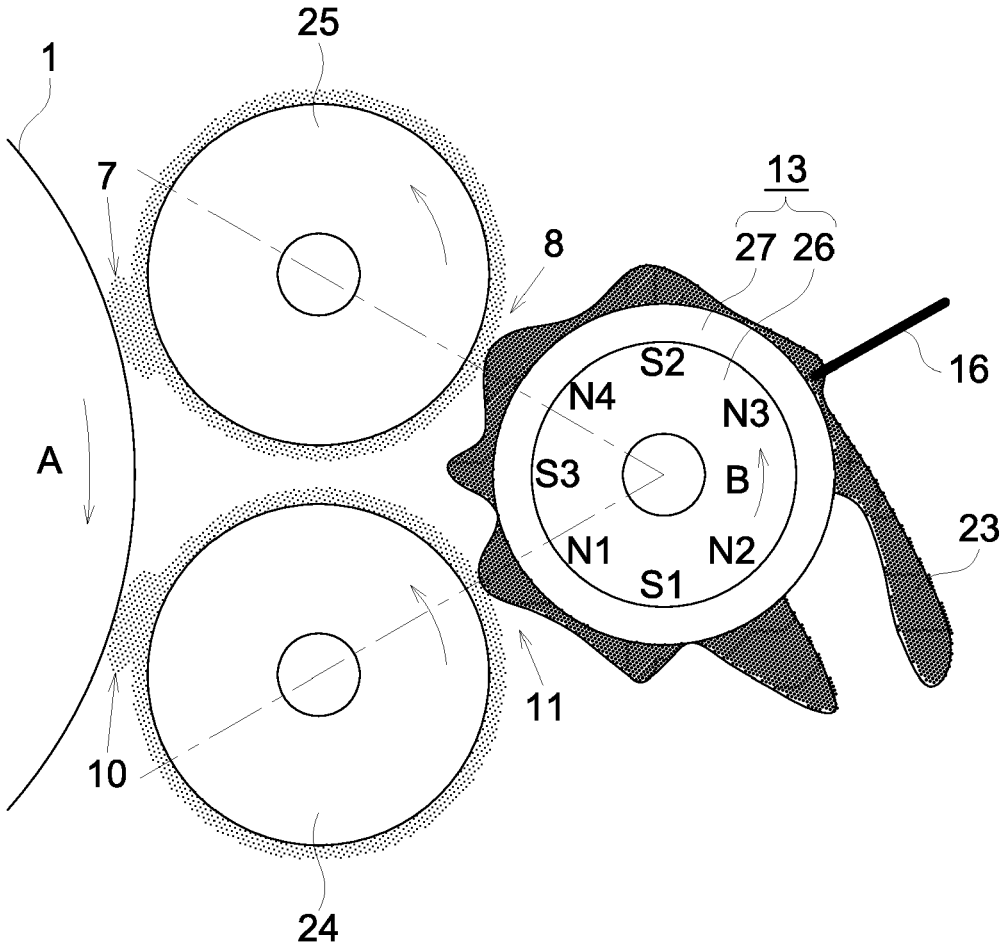
FIG. 2 is a schematic configuration diagram showing an internal major mechanism of a development apparatus 2 of FIG. 1.

FIG. 2 is an enlarged constitution view of a major part of development apparatus 2 in FIG. 1. With reference to FIG. 1 and FIG. 2, a detailed constitution example and a detailed operation example of development apparatus 2 according to the present embodiment will now be described.

<Constitution of Development Apparatus>

Developer 23 used in development apparatus 2 contains toner and carrier as described above, being accommodated in developer tank 17.

Developer tank 17 is formed of casing 20, and therein, mixing/stirring members 18 and 19 are housed. Mixing/stirring members 18 and 19 mix and stir developer 23 to supply developer 23 to developer carrier 13. In the position opposite to mixing/stirring member 19 of casing 20, ATDC (Automatic Toner Density Control) sensor 21 for toner density detection is preferably arranged.

Development apparatus 2 typically has replenishment section 15 to replenish into developer tank 17 an amount of toner to be consumed being transferred to image carrier 1. In replenishment section 15, replenishment toner 22 sent from a hopper (not shown) accommodating the replenishment toner is replenished into developer tank 17. The replenishment operation may be controlled based on the output of ATDC sensor 21.

Development apparatus 2 includes regulation member 16 used for generating a flat developer layer to regulate the amount of developer on the developer carrier 13.

Developer carrier 13 is typically includes fixedly arranged magnet roller 26 (in the present embodiment, the magnet roller is rotatable about an axis to be adjusted, but is fixed when normally used) and a rotatable sleeve roller 27 containing therein the magnet roller 26, and is supplied with a toner supplying bias, when forming an image, so that toner is supplied to the toner carrier.

Image carrier 13 has seven magnetic poles of N1, S1, N2, N3, S2, N4, and S3 along the rotating direction of sleeve roller 12 as shown in FIG. 2. Main magnetic pole N1 in the magnetic poles is arranged in the position of second toner supply area 11 facing first toner carrier 24, and another main magnetic pole N4 is arranged in first toner supply area 8 facing second toner carrier 25 (although the embodiment is equipped with a mechanism for adjusting the position s of the magnetic poles which affect image quality, it will be described in detail later).

Regarding homopolar sections N2 and N3, N2 is arranged in the position facing the interior of developer tank 17 to generate a repulsive magnetic field to strip developer 23 on sleeve roller 27, and magnetic pole N3 is arranged in the position facing mixing/stirring member 18 so as to supply developer to sleeve 27 from mixing/stirring member 18.

<Configuration of Toner Carrier>

Each of two toner carriers 24 and 25 is arranged so as to face developer carrier 13 and image carrier land is supplied with a development bias for developing an electrostatic latent image on image carrier 1.

Toner carriers 24 and 25 can be made of any material as long as they can be supplied with the above voltage. An example thereof includes an aluminum roller treated with a surface treatment such as alumite. In addition, usable material is an electrically conductive substrate such as aluminum which is coated with, for example, resin such as polyester resin, polycarbonate resin, acrylic resin, polyethylene resin, polypropylene resin, urethane resin, polyamide resin, polyimide resin, polysulfone resin, polyether ketone resin, vinyl chloride resin, vinyl acetate resin, silicone resin, fluorine resin; or rubber such as silicone rubber, urethane rubber, nitrile rubber, natural rubber, or isoprene rubber. Coating materials are not limited thereto.

Further, an electrically conductive agent may be added to the bulk or the surface of the above coating layer. The electrically conductive agent includes electron conductive agent and ion conductive agent. As the electron conductive agent, examples include without limitation, carbon black such as Ketjen black, acetylene black, or furnace black and fine particles such as metal powder or metal oxides. As the ion conductive agent, examples include without limitation, cationic compounds such as quaternary ammonium salt, amphoteric compounds, and ionic polymer materials. Further, an electrically conductive roller made of metal material such as aluminum can be employed.

<Operation of Development Apparatus>

Similarly, with reference to FIG. 1 and FIG. 2, an operation example of development apparatus 2 will now be detailed.

Developer 23 in developer tank 17 is mixed and stirred by rotation of mixing/stirring members 18 and 19, being circularly conveyed in developer tank 17 while triboelectric charging is carried out, and the developer is then supplied to sleeve roller 27 of developer carrier 13.

Developer 23 is held on the surface side of sleeve roller 27 by the magnetic force of magnetic roller 26 inside developer carrier 13 and rotationally moved along with sleeve roller 27. Then, the passing amount thereof is regulated by regulation member 16 arranged facing developer carrier 13.

Then, the developer 23 s conveyed to first toner supply area 8 facing second toner carrier 25.

In first toner supply area 8 which is a facing portion of second toner carrier 25 and developer carrier 13, the toner in developer 23 is supplied to second toner carrier 25 by a force applied to the toner, which force is generated by a toner supply electric field formed by the potential difference between the development biases applied to second toner carrier 25 and the toner supply bias applied to developer carrier 13.

In general, bias in which an alternating current voltage is superimposed on a direct current voltage is applied to second toner carrier 25, and a direct current voltage or a bias in which an alternating current voltage is superimposed on a direct current voltage is applied to developer carrier 13. Thus, an electric field in which an alternating electrical filed is superimposed on a direct electrical filed is formed in first toner supply area 8.

Further, in first toner supply area 8, the post-development residual toner on second toner carrier 25 is recovered by a recovery action of developer 23 on developer carrier 13.

Residual developer 23 having been passed through first toner supply area 8 is rotationally moved along with sleeve roller 27 of developer carrier 13, and conveyed to second toner supply area 11 opposite to first toner carrier 24 after passing through magnetic pole S3.

In second toner supply area 11, in which first toner carrier 24 faces developer carrier 13, similarly to first toner supply area 8, the toner in developer 23 is supplied to first toner carrier 24 by a force applied to the toner, which force is generated by an electric field formed by the potential difference between development bias applied to first toner carrier 24 and toner supply bias applied to developer carrier 13.

Also in this case, similarly to first toner supply area 8, a bias in which an alternating current voltage is superimposed on a direct current voltage is applied to first toner carrier 24, and a direct current voltage or a bias in which an alternating current voltage is superimposed on a direct current voltage is applied to developer carrier 13. Thus, an electric field in which an alternating electrical filed is superimposed on a direct electrical filed is formed in second toner supply area 11.

Further, in second toner supply area 11, similarly to first toner supply area 8, the post-development residual toner on first toner carrier 24 is recovered by a recovery action of developer 23 on developer carrier 14

In the figure, the rotating directions of first toner carrier 24 and second toner carrier 25 are set to be the same as the rotating direction of developer carrier 13. However, both of the toner carriers can be set to be rotated reversely with respect to developer carrier 13, or any one of them can be set to be rotated in the reverse direction.

As in the figure, when they are rotated in the same direction, developer carrier 13 and each of toner carriers 24 and 25 rotate in a counter direction to each other in the facing portion t.

In the hybrid development method, it is important that the toner is supplied after the contrasting density between the region from which the toner has been used for development and the region from which the toner has not been used for development is reduced as much as possible, in order to reduce the occurrence of development hysteresis (ghost). When counter movement is made in the facing portion between developer carrier 13 and each of first and second toner carriers 24 and 25, the relative speed is increased, thus the mechanical recovery force is further enhanced, resulting in an advantage in recovering the post-development residual toner.

Therefore, it is desirable to set the rotating directions of developer carrier 13 and first and second toner carriers 24 and 25 to be in the counter direction in order to reduce development hysteresis (ghost).

In first toner supply area 8, a toner layer supplied onto second toner carrier 25 from developer carrier 13 is conveyed to first development area 7 with the rotation of second toner carrier 25, and is used for a first step development, being transferred by an electric field formed by the development bias applied to second toner carrier 25 and a latent image potential on image carrier 1.

In first development area 7, the toner is moved by the electric field in a development gap defined between second toner carrier 25 and image carrier 1.

Although well-known various types of biases are applicable as the development bias, a bias in which an alternating current voltage is superimposed on a direct current voltage is typically applied. Thereafter, the post-development residual toner layer, from which the toner has been consumed in first development area 7, is conveyed to first toner supply area 8 with the rotation of second toner carrier 24.

Further, in the same manner, in second toner supply area 11, a toner layer supplied onto first toner carrier 24 from developer carrier 13 is conveyed to second development area 10 with the rotation of first toner carrier 24, and is used for a second step development, being transferred by an electric field formed by the development bias applied to first toner carrier 24 and a latent image potential on image carrier 1.

Also in second development area 10, similarly to first development area 7, the toner is moved by the electric field in a development gap defined between first toner carrier 24 and image carrier 1 (although the embodiment is equipped with a mechanism for adjusting the position s of the magnetic poles which affect image quality, it will be described in detail later).

Although well-known various types of biases are applicable as the development bias, a bias in which an alternating current voltage is superimposed on a direct current voltage is typically applied. Thereafter, the toner layer, from which the toner has been consumed in second development area 10, is conveyed to second toner supply area 11 with the rotation of first toner carrier 24.

Developer 23 having been passed through second toner supply area 11 is further conveyed toward developer tank 17 with the rotation of sleeve 27 and stripped off from developer carrier 13 by a repulsive magnetic field formed in the position corresponding to a developer recovery position, thereby being recovered into developer tank 17.

When a replenishment control section (not shown) provided on replenishment section 15 detects, from an output value of ATDC sensor 21, that the toner density in developer 23 has become down to the minimum toner density to ensure an appropriate image density, replenishment toner 22 stored in the hopper is supplied through toner replenishment section 15 into developer tank 17 by a toner replenishment member (not shown).

It should be noted that in the above-mentioned embodiment the second toner carrier performs the first step development and the second toner carrier performs the second step development.

(Setting Conditions for a Plurality of Toner Carriers and Image Quality in)

As described above, to solve the problems of image degradation and occurrence of development hysteresis (ghost), the image forming apparatus according to the present embodiment is provided with development apparatus 2 having a plurality of toner carriers (first toner carrier 24 and second toner carrier 25).

However, as shown in FIG. 2, when first toner carrier 24 and second toner carrier 25 are employed, it is very likely that magnetic pole position shifting in toner supply areas 11 and 8, in which carrier 13 and each of the toner carriers are opposed to each other, occurs and development gap variations in development areas 10 and 7, in which each toner carrier and image carrier 1 are opposed to each other, occur.

Further, when a plurality of toner carriers are employed, in the case of adjusting the magnetic pole position and gap for each thereof, an interference action may occur in which adjusting one toner carrier causes an error of the other toner carrier, which cannot be overcome only by a simple adjustment mechanism In development apparatus 2 employing the hybrid development method, the development gaps between image carrier 1 and the first and second toner carriers largely affect image formation. Therefore, to obtain an appropriate image density in a formed image, a development gap stabilizing mechanism is provided in which the development gaps between image carrier 1 and first toner carrier 24 as well as second toner carrier 25 are not varied and thereby each development gap is stably ensured to be uniform in the axis direction.

Further, to form a toner thin layer having an appropriate amount on each of the surfaces of the first and second toner carriers, a magnetic pole position adjustment mechanism is provided in which the magnetic pole position of magnet roller 26, incorporated in developer carrier 13, opposed to each toner carrier is adjusted and arranged at an appropriate position.

The magnetic pole position adjustment mechanism and the development gap stabilizing mechanism in development apparatus 2 will now schematically be described.

<Rough Adjustment Operations>

(1) Adjust the magnet roller by rotating it about its shaft to an appropriate position with respect to the toner supply area facing one of the toner carriers, based on magnetic pole position inspection data having been previously measured with respect to the magnet roller of a developer carrier and an output image after assembling an image forming apparatus.

(2) Adjust the other toner carrier, by rotating a holding member which holds the other toner carrier movable about the shaft of the magnet roller, to an appropriate position with respect to the toner supply area facing said toner carrier, similarly based on the magnetic pole position inspection data of the magnet roller and the output image after assembling the image forming apparatus.

By the above adjustment operations, the magnetic pole positions are optimized, whereby toner supply from the developer carrier to each toner carrier and recovery of the post-development residual toner are efficiently carried out. Thereby, a toner thin layer having an appropriate amount can be uniformly formed on each toner carrier.

However, by the adjustment operations, the positions of the two toner carriers with respect to the image carrier are deviated. Therefor, the following development gap correction is carried out.

(3) Urge the development apparatus while inclining it and guiding it using a guide member having a groove which is rotatable around the shaft of one toner carrier in such a way that gap members provided on both ends of each toner carrier are in contact with the image carrier.

By the above gap correction operation, even in the case in which the positions of the two toner carriers with respect to the image carrier are deviated, when gap members which have an outer diameter larger than those of the toner carriers, and are arranged at both ends of each toner carrier in an coaxial manner with respect to the toner carrier, are surely brought into contact with the image carrier, the development gap between the image carrier and each of the two toner carriers is maintained with a specific gap, and thereby image defects are inhibited, resulting in obtaining a high quality image.

With regard to the magnetic pole position adjustment mechanism and the development gap stabilizing mechanism in development apparatus 2, the detail constitution thereof enabling the above operations will now be described.

Herein, in the following description, description will be made employing the distinction of above first toner carrier 24 and second toner carrier 25 as is. However, first toner carrier 24 and second toner carrier 25 is interchangeable.

Namely, even in the case where the first toner carrier performs a first step development and the second toner carrier performs a second step development, the following description on the magnetic pole position adjustment mechanism and the development gap stabilizing mechanism can be applied without any change.

(Adjustment Mechanism for Magnetic Pole Position in a Toner Supply Area)

Figure 3:
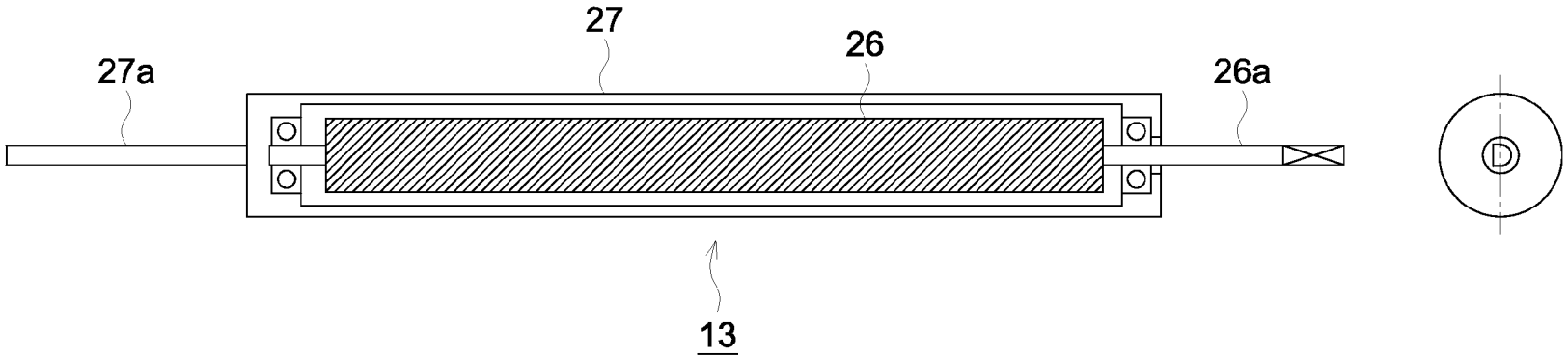
FIG. 3 is a diagram showing a cross section in a longitudinal direction of a developer carrier of the development apparatus of FIG. 1.
Figure 4:
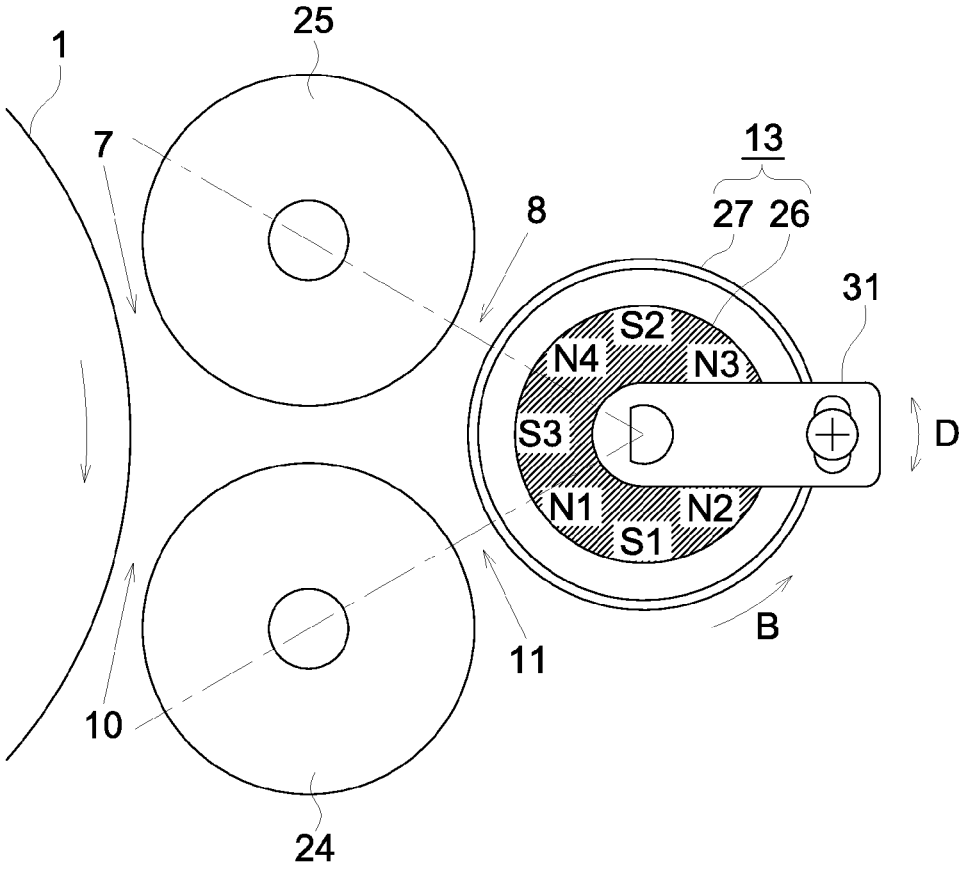
FIG. 4 is a diagram showing an example of a first magnetic pole adjustment mechanism of the development apparatus 2.

With reference to FIG. 3 and FIG. 4, as well as FIGS. 5*a*, 5*b* and FIGS. 6*a*, 6*b*, there will be detailed a mechanism to adjust the magnetic pole position of magnet roller 26 incorporated in developer carrier 13 in development apparatus 2 according to the present embodiment and the magnetic pole position in toner supply areas facing first toner carrier 24 and second toner carrier 25.

Figure 5A:
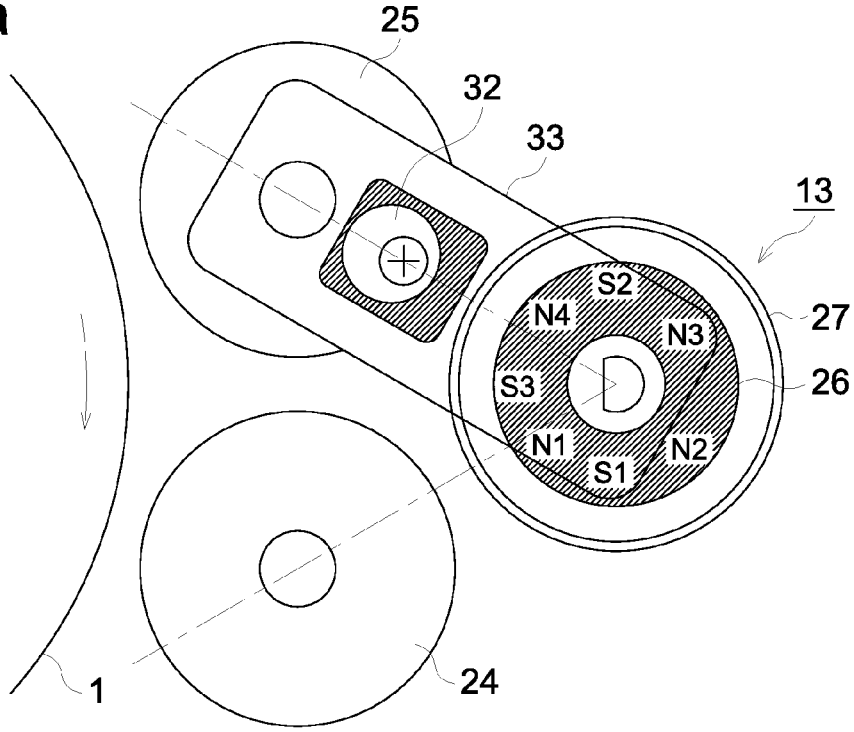
FIGS. 5*a* and 5*b* are diagrams showing an example of a second magnetic pole adjustment mechanism of the development apparatus 2.
Figure 5B:
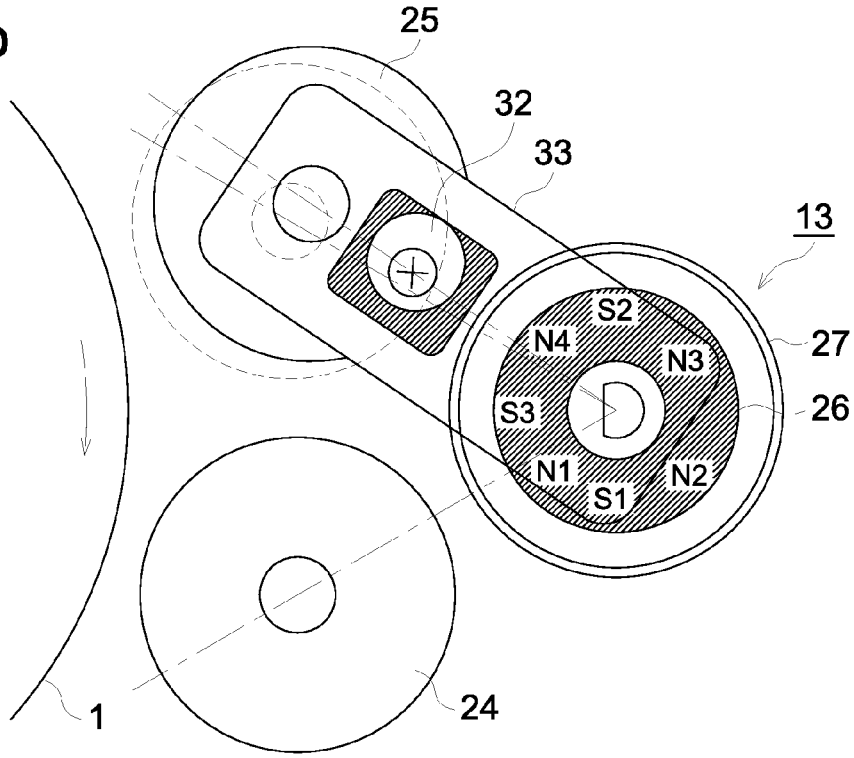
Figure 6A:
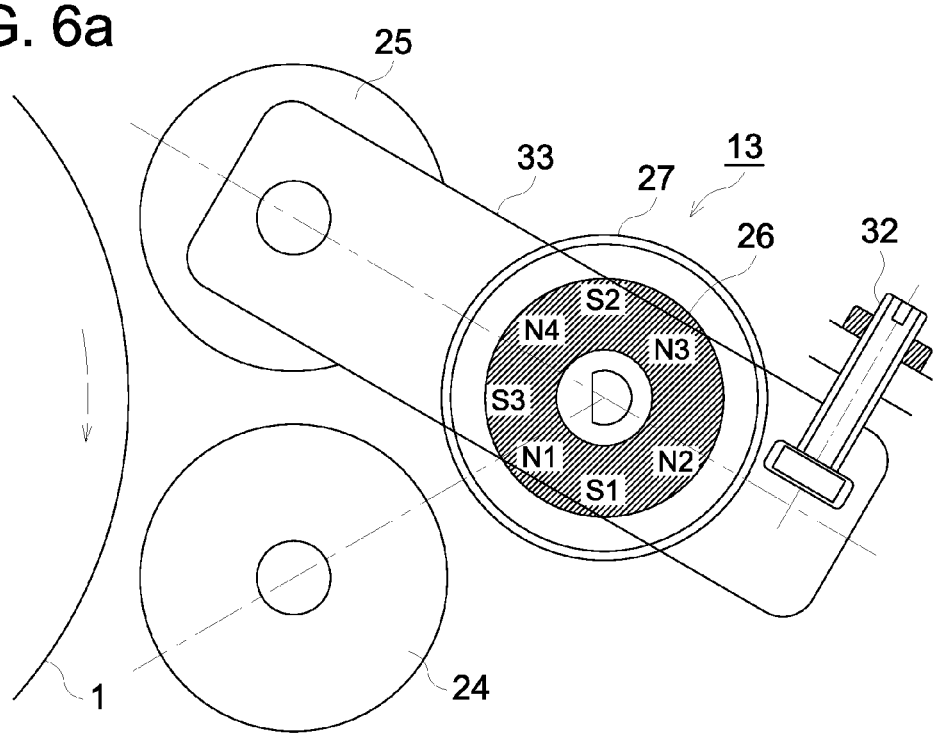
FIGS. 6*a* and 6*b* are diagrams showing another example of a second magnetic pole adjustment mechanism of the development apparatus 2.
Figure 6B:
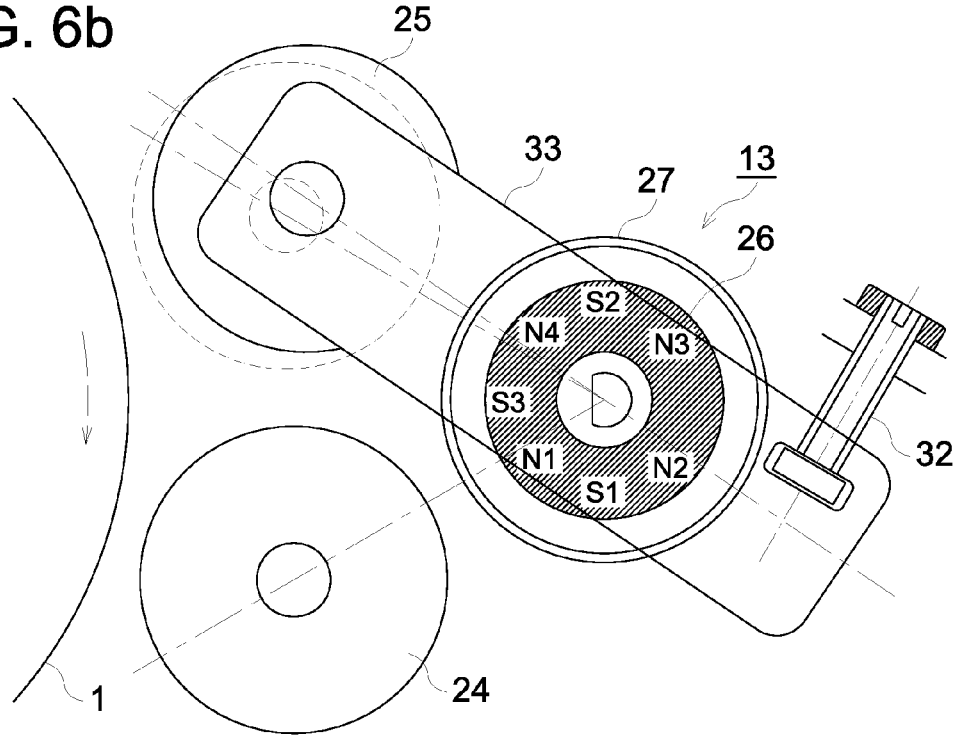

FIG. 3 is a longitudinal direction cross-sectional view of developer carrier 13 in development apparatus 2. FIG. 4 is a schematic view showing one example of a first magnetic pole position adjustment mechanism in development apparatus 2. FIGS. 5*a* and 5*b* is a schematic view showing one example of a second magnetic pole position adjustment mechanism in development apparatus 2. FIGS. 6*a* and 6*b* are schematic views showing another example of a second magnetic pole position adjustment mechanism in development apparatus 2. FIGS. 5*a* and 6*a* represent the state prior to the adjustment, and FIGS. 5*b* and 6*b* represents the state after the adjustment (from the broken line to the solid line).

As shown in FIG. 3, developer carrier 13 is constituted by magnet roller 26 arranged rotatably around shaft 26*a* and sleeve 27 which contains therein magnet roller 26 and is rotatable around shaft 27*a*, independently of magnet roller 26. To cause the magnetic pole position of magnet roller 26 to turn, a D-shaped cut is provided in the shaft end of shaft 26*a*.

As shown in FIG. 4, magnet roller 26 has seven magnetic poles of N1, S1, N2, N3, S2, N4, and S3 along rotation direction B of sleeve roller 27. In these magnetic poles, magnetic pole N1 is arranged at the position of second toner supply area 11 facing first toner carrier 24. Further, magnetic pole N4 is arranged at the position of first toner supply area 8 facing second toner carrier 25.

Further, regarding homopolar portions N2 and N3, magnetic pole N2 is arranged at a position in which magnetic pole N2 generates a repulsive magnetic field at a position facing the interior of developer tank 17 to separate developer 23 on sleeve roller 27, and magnetic pole N3 is arranged at a position facing mixing/stirring member 18 to supply developer 23 from developer tank 17 to sleeve roller 27.

First toner carrier 24 is arranged in parallel to sleeve roller 27 such that the between the surface of toner carrier 24 and the surface of sleeve roller 27 of developer carrier 13 is a set value (0.2 mm-1.0 mm), and is mounted to development apparatus housing 20 being rotatable around the shaft. To perform the position adjustment of magnetic pole N1 of magnet roller 26 with respect to toner supply area 11 facing first toner carrier 24, there is provided first adjustment member 31 for realizing a first magnetic pole position adjustment mechanism, as shown in FIG. 4.

First adjustment member 31 is fitted with the D-shaped cut of shaft 26*a* of magnet roller 26*a* to cause magnet roller 26 to turn around shaft 26*a* (arrow mark D of FIG. 4), whereby the magnetic pole position can be adjusted. In addition, first adjustment member 31 can be fixed to development apparatus after completion of the adjustment.

On the other hand, as shown in FIGS. 5*a* and 5*b*, holding member 33 is rotatable around shaft 26*a* of magnet roller 26 and is also arranged to hold second toner carrier 25 being movable around the shaft such that the gap between the surface of the second toner carrier 25 and the surface of sleeve roller 27 of developer carrier 13 is a set value (0.2 mm-1.0 mm).

Second adjustment member 32 for realizing a second magnetic pole position adjustment mechanism is provided in holding member 33 so that toner supply area 8 facing second toner carrier 25 is adjusted to the position of magnetic pole N4 of magnet roller 26.

Second adjustment member 32 is made up of an eccentric pin which can be fixed to development apparatus housing 20. The rotation of this eccentric pin causes holding member 33 to turn around shaft 26*a* of magnet roller 26.

Thus, second toner carrier 25 held by holding member 33 makes it possible to carry out a position adjustment to align toner supply area 8 with the position of magnetic pole N4 of magnet roller 26.

As shown in FIGS. 6*a* and 6*b*, the second magnetic pole position adjustment mechanism may be realized by second adjustment member 32 made up of a screw. In this case, tightening or loosening the screw causes holding member 33 to turn around shaft 26*a* of magnet roller 26.

<Confirmation of the Adjustment Position>

Due to production or assembling error, magnetic poles N1 and N4 of the magnet roller can be arranged at a position where the positional relationship between each magnetic pole and the opposed toner carrier is deviated from the optimum position. However, as described below, adjustment can be carried out by a method based on magnetic pole position inspection data having been previously measured with respect to the magnet roller and an output image after assembling the image forming apparatus.

Figure 7:
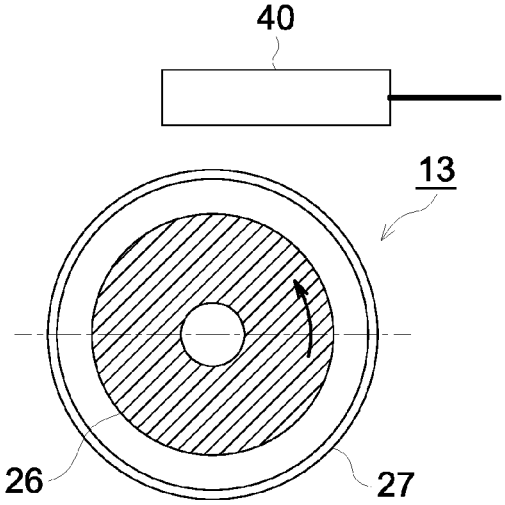
FIG. 7 is a schematic configuration diagram showing a measurement apparatus for measuring a magnetic pole position of a developer carrier.

In production inspection of developer carrier 13 (magnet roller 26), as shown in FIG. 7, using magnetic pole position measurement device 40, magnetic flux density is measured in the circumferential direction to determine the magnetic pole position. As magnetic pole position measurement device 40, for example, a gaussmeter (HGM-8300LW and biaxial probe WS-10, produced by ADS, Inc.) is cited.

As described above, first adjustment member 31 and second adjustment member 32 are adjusted based on inspection data of the magnetic pole position.

Further, after the assemble of the image forming apparatus, an inspection image, in which a solid image is actually arranged at regular intervals, is output, and then first adjustment member 31 and second adjustment member 32 may be adjusted so that the density difference of the solid image is not greater than a certain value.

(Adjustment Mechanism for Development Gap in a Development Area)

Figure 8:
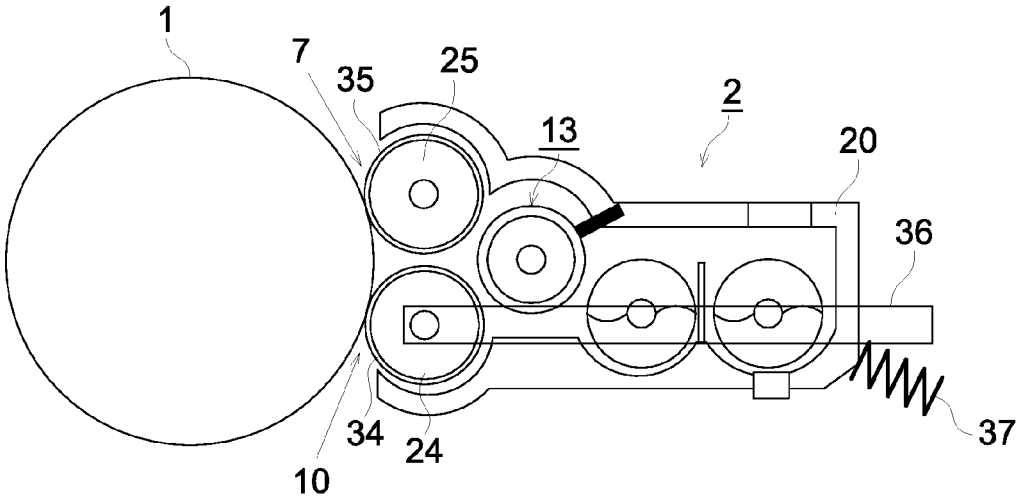
FIG. 8 is a schematic diagram showing a development gap stabilizing mechanism of an image forming apparatus of the present embodiment according to the present invention.

Next, with reference to FIG. 8, in the image forming apparatus according to the present embodiment, there will be detailed a mechanism to stabilize the development gaps in development areas in which image carrier 1 and each of first toner carrier 24 and second toner carrier 25 are opposed to each other.

FIG. 8 is a schematic view showing one example of the development gap stabilizing mechanism in the image forming apparatus according to the embodiment of the present invention.

At both ends of each of first toner carrier 24 and second toner carrier 25, ring-shaped first gap members 34 and second gap members 35, whose radius is larger than that of toner carrier by a certain length (0.1 mm-0.4 mm) which is a preferable gap between each of the toner carriers and image carrier 1, are arranged rotatably on the shafts of first toner carrier 24 and second toner carrier 25, respectively.

First gap member 34 and second gap member 35 are desirably formed of a low friction member.

Such a low friction member may be formed of a resin material with small friction coefficient such as polyacetal. Further, the inner and the outer cylindrical surfaces with which image carrier 1 and the shafts of first toner carrier 24 and second toner carrier 25 are in slidable contact may be made of metal material coated with a fluorine resin. Still further, a common ball bearing which is commercially available may be built in the inner side of the cylindrical surface.

The above magnetic pole position adjustment deviates the positions of first toner carrier 24 and second toner carrier 25 from the designed positions, whereby first gap member 34 or second gap member 35 is off the surface of image carrier 1. To deal with this issue, the development gaps between image carrier 1 and each of first toner carrier 24 and second toner carrier 25 are stabilized using the following development gap stabilizing mechanism.

As shown in FIG. 8, the development gap stabilizing mechanism is realized by guide member 36 and bias member 37.

Guide member 36, which is provided so as to mount development apparatus 2 on the image forming apparatus, has a guide groove (in FIG. 8, only the guide groove is shown as the reference numeral 36) to regulate the motion of the shaft of first toner carrier 24 in the vertical direction, in the vicinity of the contact position between toner carrier 24 and image carrier 1.

Development apparatus housing 20 is pushed by bias member 37 from obliquely downward, whereby development apparatus 2 is inclined around the shaft center of first toner carrier 24, and then both first gap members 34 and second gap members 35 are brought into contact with image carrier 1. Whereby, the gaps between image carrier 1 and each of first toner carrier 24 and second toner carrier 25 can stably be maintained.

Further, employable is a constitution in which the guide member 36 is slidably adjustable together with the development apparatus housing 20 in the direction connecting the first toner carrier 24 and the second toner carrier 25 and development apparatus housing 20 is biased toward the image carrier 1 along the guide groove by the bias member 37.

In this manner, according to the image forming apparatus according to the present embodiment, an image forming apparatus provided with a hybrid development apparatus having a plurality of toner carriers has a constitution capable of carrying out the following adjustments.

To be specific, in this constitution, a magnet roller is allowed to rotate with respect to the opposed portion to one toner carrier and adjusted and fixed at an appropriate magnetic pole position, and then the other toner carrier is allowed to move around the magnet roller shaft with a certain gap, whereby the opposed portion can be adjusted and fixed at an appropriate magnetic pole position.

Further, in the constitution, gap members are provided for each toner carrier to accurately maintain the gap to the image carrier, and then the development apparatus is energized by a guide member and an bias member provided on the image forming apparatus so as to bring the gap members into contact with the image carrier, whereby gap deviation resulting from the above magnetic pole position adjustment is corrected and maintained to a specific development gap.

With such a simple constitution, the magnetic pole positions of the magnet roller incorporated in the developer carrier can be adjusted at appropriate positions with respect to each toner carrier, whereby toner supply to and toner recovery from each of the toner carriers is optimized; and at the same time, the development gap between the image carrier and the each toner carrier is uniformly maintained at a specific value, whereby nonuniformity, image background fog, and image defects such as development hysteresis are decreased, resulting in formation of a sharp and high quality image.

The above embodiment is just an example and does not limit the present invention at any respect. The scope of the present invention is indicated not by the above embodiment but by the description of the appended clams, and is intended to includ the meaning equivalent to the claims and all modifications within the scope.

What is claimed is:

1. An image forming apparatus, comprising:

an image carrier;

a development apparatus configured to develop with toner an electrostatic latent image formed on the image carrier, the development apparatus including:

a first toner carrier and a second toner carrier which are provided to face the image carrier, and each of which is configured to support the toner on a surface thereof and to convey the toner to develop the electrostatic latent image formed on the image carrier;

a developer carrier, the developer carrier having:

a magnet roller having a rotary shaft and a plurality of magnetic poles around the rotary shaft, the magnetic roller being capable of rotation about the rotary shaft to adjust positions of the magnetic poles; and a sleeve roller which is provided to face the first toner carrier and the second toner carrier and is configured to contain therein the magnet roller and to be rotatable, independently of the magnet roller, about the rotary shaft, and configured to support thereon developer containing toner and carrier and to convey the developer to supply the toner in the developer to the first toner carrier and the second toner carrier;

a first adjustment member which is mounted on the rotary shaft so as to rotate the magnet roller and is configured to adjust and then to fix the magnet roller so that a facing portion between the developer carrier and the first toner carrier is located at a predetermined position with respect to the magnetic poles;

a holding member which is provided to be connected with the rotary shaft of the magnet roller and to be rotatable about the rotary shaft, and configured to rotatably hold the second toner carrier at a position thereof which is a predetermined distance away from a position at which the holding member is connected with the rotary shaft;

a second adjustment member which is provided in contact with the holding member and is configured to rotate the holding member about the rotary shaft of the magnet roller and then to fix the holding member such that a facing portion between the image carrier and the second toner carrier is located at a predetermined position with respect to the magnet poles;

a pair of first gap members each of which is provided, on each of both end portions of the first toner carrier, coaxially with the first toner carrier, and has an outer diameter larger than a diameter of the first toner carrier;

a pair of second gap members each of which is provided, on each of both end portions of the second toner carrier, coaxially with the second toner carrier, and has an outer diameter larger than a diameter of the second toner carrier;

a guide member configured to guide the development apparatus in such a direction that all of the first gap members and the second gap members approach the image carrier; and a bias member configured to bias the development apparatus in such a direction that all of the first gap members and the second gap members are in contact with the image carrier.

2. The image forming apparatus of claim 1, wherein the rotary shaft of the magnet roller has a non-circular cross section so that the first adjustment member is fixedly mounted at a predetermined angle, the first adjustment member is fit in the rotary shaft at a portion having the non-circular cross section, and rotation of the first adjustment member causes the magnet roller to rotate about the rotary shaft by rotation thereof.

3. The image forming apparatus of claim 1, wherein the second adjustment member includes an eccentric pin which is provided in contact with the holding member, and whose rotation causes the holding member to rotate about the rotary shaft of the magnet roller.

4. The image forming apparatus of claim 1, wherein the second adjustment member includes a screw provided in contact with the holding member, and the holding member is rotated about the rotary shaft by fastening or loosening the screw.

5. The image forming apparatus of claim 1, wherein the development apparatus includes:

a housing on which the first carrier, the second carrier, and the developer carrier are mounted, wherein the guide member has a groove in which a rotary shaft of the first toner carrier is slidably held, so that the guide member guides the development apparatus along the groove while controlling movement of the rotary shaft of the first toner carrier in a direction of the groove.

6. The image forming apparatus of claim 5, wherein the bias member includes a spring whose elastic force acts on the housing of the development apparatus in a direction inclined from a guide direction of the guide member.

* * * * *